United States Patent [19]

Siemon et al.

[11] Patent Number: 5,044,979

[45] Date of Patent: Sep. 3, 1991

[54] CONNECTOR BLOCK AND TERMINAL

[75] Inventors: John A. Siemon, Woodbury; Howard Reynolds, Waterbury, both of Conn.

[73] Assignee: The Siemon Company, Watertown, Conn.

[21] Appl. No.: 420,246

[22] Filed: Oct. 12, 1989

[51] Int. Cl.[5] ..... H01R 4/24

[52] U.S. Cl. ..... 439/404; 439/724

[58] Field of Search ..... 439/389–407, 439/417–419, 707, 709, 713, 721, 723, 724

[56] References Cited

U.S. PATENT DOCUMENTS

| | | | |
|---|---|---|---|
| 1,921,823 | 8/1933 | Hosking . | |
| 3,777,301 | 12/1973 | Michaels . | |
| 3,910,672 | 10/1975 | Frantz | 439/417 |
| 4,171,857 | 10/1979 | Forberg et al. . | |
| 4,279,460 | 7/1981 | Forberg et al. . | |
| 4,283,103 | 8/1981 | Forberg et al. . | |
| 4,452,502 | 6/1984 | Forberg et al. . | |
| 4,533,196 | 8/1985 | Forberg et al. . | |
| 4,541,682 | 9/1985 | Gerke et al. . | |
| 4,547,034 | 10/1985 | Forberg et al. . | |
| 4,580,870 | 4/1986 | Gerke . | |
| 4,615,576 | 10/1986 | Gerke et al. . | |
| 4,634,209 | 1/1987 | Forberg et al. . | |
| 4,846,735 | 7/1989 | Teichler et al. . | |

FOREIGN PATENT DOCUMENTS

| | | |
|---|---|---|
| 2040805 | 2/1972 | Fed. Rep. of Germany . |
| 919480 | 11/1966 | France . |
| 659316 | 10/1951 | United Kingdom . |
| 2129716 | 5/1984 | United Kingdom . |

*Primary Examiner*—David L. Pirlot

*Attorney, Agent, or Firm*—Fishman, Dionne & Cantor

[57] ABSTRACT

A connecting block is provided which comprises two interlocking parts including a retainer and a snap-on cover. Both the retainer and cover include internal cavities which are sized to receive a plurality of spaced terminal clips and retain the clips in a precise orientation. Each of the terminal clips has a novel V-shaped configuration wherein a stripping slot is located at the base of the V. Two embodiments of clips are disclosed including a single contact and a dual contact clip. Both the single and dual contact clip embodiments include cantilevered members for circuit testing. Thus, the connecting block of this invention will permit either parallel test access or break test access.

20 Claims, 12 Drawing Sheets

CONNECTOR BLOCK AND TERMINAL

BACKGROUND OF THE INVENTION

This invention relates to the field of multiple electrical connectors and mounting blocks therefor. More particularly, this invention relates to a new and improved mounting block and associated electrical terminal which is particularly useful as a telecommunications connector block.

Solderless multiple connectors have found applicability in many fields, particularly in the field of telecommunications equipment. These connectors may be used to establish interconnections between small diameter, insulated conductors in confined spaces where the use of screw type terminal strips or similar connecting devices are not suitable. In addition, some of these prior art connectors strip away the insulation from conductors inserted therein. These terminals incorporate an insulation displacement connector (IDC) portion.

The present invention relates to a connecting block and terminal wherein the connecting block comprises a retainer base for receiving a plurality of terminals and a cover which is snapped onto the base for retaining the terminals in precise orientations. Prior art examples of this general type of connecting block and terminal are found in U.S. Pat. Nos. 4,547,034 and 4,615,576. It will be appreciated that while connecting blocks and terminals of this type are in prevalent use, there continues to be a need for improvements to both the block and terminal design. Specifically, there is a need for improvements to the latch mechanism which provides attachment between the connecting block and mounting bracket. There is also a need for an improved IDC terminal configuration. Presently, there are at least four types of terminals used in teleconnections blocks including:

1. Simple "tuning fork" design
2. Cylindrical "barrel" design
3. "Looped wire" design
4. Inclined "tuning fork" design The simple tuning fork design, which is best described as two parallel beams sharing an integral base and defining, between them, a slot for the termination of insulated or bare wire, is the most common of all IDC contact designs. One limiting aspect of this contact type is that, as wire is terminated, the pivoting of the beams results in a tapered slot which leads to complications when terminating stranded wire due to the difficulty of keeping the wire strands in a coherent group. After termination, the slot taper also provides an uneven space for movement of individual strands which may lead to intermittent electrical connections. Another drawback to the straight tuning fork type is that, inherent to its design, are high stress gradients at the base of the slotted portion and along the beam elements, which limit the range of compatible wire gages and choice of material type to expensive, high strength alloys to avoid the onset of inelastic material yield which may degrade electrical performance. Examples of that type of IDC contact are the well known "66" terminal such as is described in U.S. Pat. No. 4,150,867, and tribeam types which are shown in U.S. Pat. No. 4,468,079.

The so called "barrel" design (which is disclosed, for example in U.S. Pat. No. 4,671,595), is comprised of a cylindrical conductor with a lengthwise slit for receiving insulated or bare wire. Unlike the simple tuning fork, this IDC type will maintain a parallel wire termination slot making it compatible with stranded wire. Also, because stresses are more evenly distributed, it is more resilient and therefore more compatible with a wide range of wire gauges and material types. The drawback of this design is that it does not permit applications where wire may be continuously looped from contact to contact. In essence, the inside of the barrel is a dead-end that prohibits the termination of wire without cutting or access to its end.

The looped wire IDC, which is disclosed, for example, in U.S. Pat. No. 4,381,880, combines the even stress distribution and parallel slot advantages of the barrel with the versatility of the straight tuning fork design. Its construction essentially consists of long cylindrical beams that are constrained at both ends such that a wire inserted between them will result in a bowing flexure which is optimal for the termination of both solid and stranded wire and for the termination of multiple wires in a single slot. The disadvantage of this contact type is that, while in manufacturing it results in virtually no process scrap, it is made by a wire forming operation which is slow and costly compared to progressive metal stamping operations used for other designs.

The inclined tuning fork IDC type makes use of a contact of the general tuning fork shape, but varied in such a way that the beam elements are thin, wide blades that are oriented and supported in a plastic housing at an angle of approximately 45° with respect to the axial orientation of the wire to be terminated. Examples of this type of terminal are disclosed in the aforementioned U.S. Pat. Nos. 4,547,034 and 4,615,576. As the wire is inserted, the inclination of the contact forces the blades to rotate in a torsional respect, thereby resulting in the desired parallel slot and reduced stress concentration compared to the straight tuning fork design. The limitations of this IDC type are that, while the plastic support along the outside edges of the contact allow the opposing sides to rotate, they do not induce planar flexure of the blades that will result in the preferred bowing of the wire termination slot and the further distribution/reduction of material stress.

Also, to overcome the natural tendency of the wire to balance these torsional forces by assuming an orientation perpendicular to the contact, wire restraints are required on both the entry and exit sides of the contact. In most applications, wire strain relief is desired, but the requirement of having two distinct and separate strain relief features per terminal is more restrictive than other designs which use strain relief, but not as an integral and required aspect of the wire electrical connection.

While the four IDC types discussed above represent the vast majority of wire termination systems used in telecommunications networks today, it will be appreciated that, other prior art IDC contact designs presently in use are wrought with similar limitations in construction and performance.

SUMMARY OF THE INVENTION

The above-discussed problems and deficiencies of the prior art are overcome or alleviated by the connecting block and associated terminal of the present invention. In accordance with the present invention, a connecting block is provided which comprises two interlocking parts including a retainer or base and a snap on cover. Both the retainer and cover include internal cavities which are sized to receive a plurality of spaced terminal clips and retain said clips in a precise orientation. Each of the terminal clips has a novel V-shaped configuration wherein a stripping slot or IDC is located at the base of the V. Two embodiments of clips are disclosed including a single contact and a dual contact clip. Both the single and dual contact clip embodiments include cantilevered members for circuit testing. Thus, the connecting block of this invention will permit either parallel test access or break test access for enabling technicians to disconnect and reconnect circuits quickly and easily. The electrical terminal clips of this invention are capable of terminating 20–28 AWG solid or stranded wire and allow two wires per stripping slot.

In a preferred embodiment, the connecting block of the present invention is capable of making cross-connections for ten twisted pair circuits and will terminate up to four wires in common. The connecting block and terminal configuration of this invention may be used with mounting hardware, installation tools and accessories that are standard in many countries throughout the world. In addition, the novel "V-clip" contact configuration will give the connecting block of this invention significant dependability and versatility in terms of installation life and compatible wire types with lower cost alloys and about one-half the material content of standard "66-type" clips. A connecting block of this invention also includes several improvements over existing blocks of the same general type including a novel mounting bracket latch configuration which may be defeated without the use of tools for service and maintenance.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
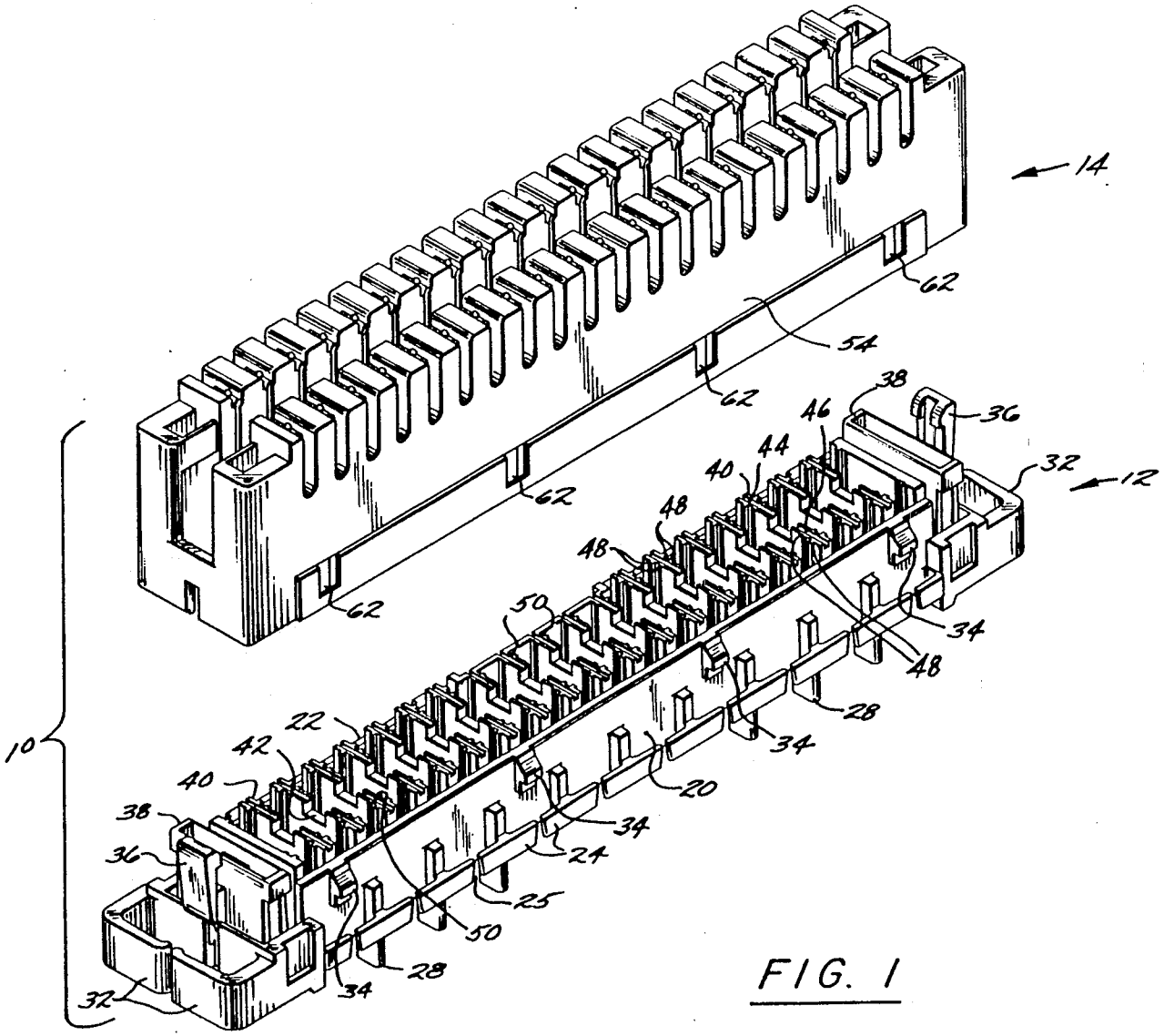
FIG. 1 is an exploded perspective view of a retainer and cover which compose the connecting block of the present invention.
Figure 2:
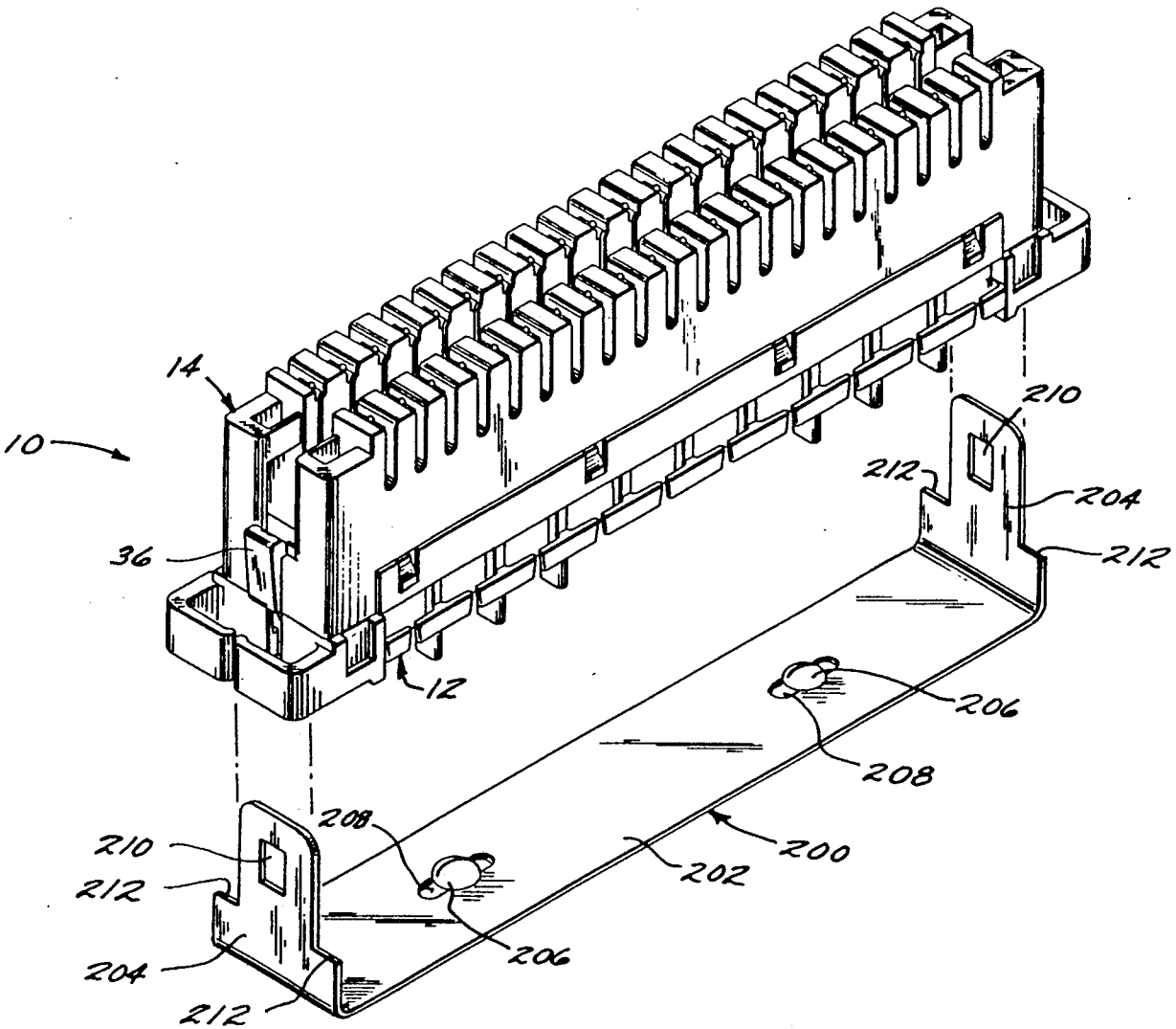
FIG. 2 is a perspective view depicting the assembled connecting block of FIG. 1.

The connecting block of the present invention is shown generally at 10 in FIGS. 1 and 2. Connecting block 10 is comprised of two attachable parts including a retainer or base 12 and a cover 14. Retainer 12 is shown in more detail with reference to FIGS. 7–13 while cover 14 is depicted in more detail with reference to FIGS. 14–20. Connecting block 10 is preferably molded from a suitable polymeric material such as polycarbonate.

Figure 3:
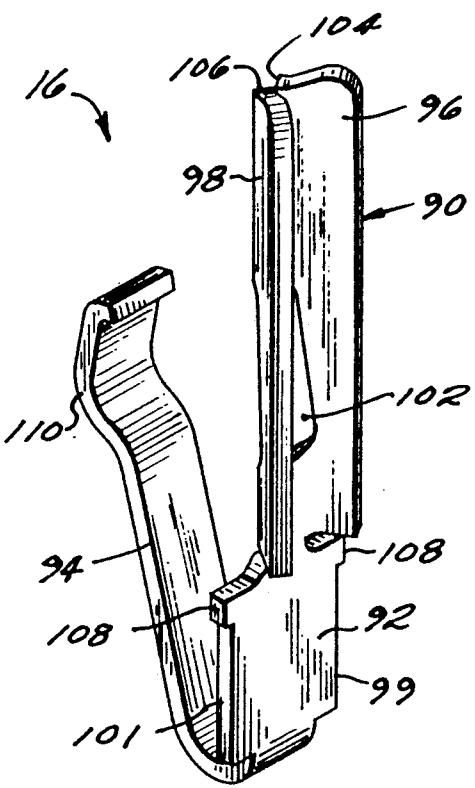
FIG. 3 is a perspective view of a first embodiment of a terminal contact in accordance with the present invention.
Figure 21:
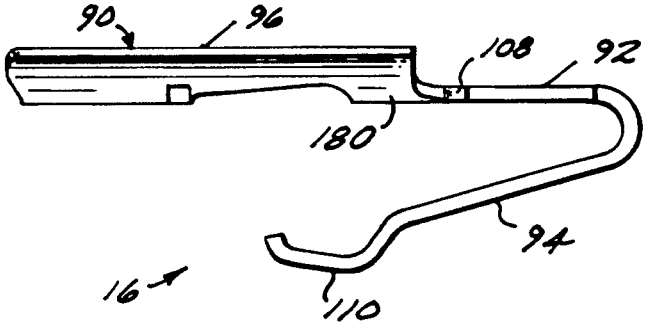
FIG. 21 is a side elevation view of the terminal clip of FIG. 3.

Connecting block 10 receives and retains a plurality of terminal clips which employ stripping slots known as insulation displacement contacts (IDC). A first embodiment of a terminal clip for use in the present invention is shown generally at 16 in FIG. 3. Terminal clip 16 is shown in more detail with reference to FIGS. 21–23; and is shown being loaded into a retainer 12 in FIG. 4. A second embodiment of a terminal clip for use with the connecting block of the present invention is shown generally at 18 in FIG. 5 and is shown in more detail with reference to FIGS. 24–27; and is shown being loaded into retainer 12 in FIG. 6.

As shown in FIG. 2, connector block 10 is received onto a known mounting bracket 200. Mounting bracket 200 is essentially U-shaped having a base 202 and a pair of outwardly facing arms 204. Bracket 200 is mounted to a frame or other surface by mounting screws 206 positioned through openings 208 in base 202. Each arm 204 of bracket 200 includes a latching receptacle 210 located near the upper ends thereof; and a pair of oppositely disposed shoulders 212 located below receptacle 210.

Turning now to FIGS. 1 and 7–13, a description follows of retainer 12. Retainer 12 has a substantially rectangular configuration and includes a pair of opposed longitudinal side walls 20 and 22. Sidewall 20 includes a fanning strip along its lower edge defined by a plurality of T-shaped members 24. Each T-shaped member 24 is integrally attached at the base thereof to sidewall 20 and the spacing 25 between each member 24 is sufficient to permit a conductive wire to pass therethrough. The two longitudinal sidewalls 20 and 22 extend upwardly from a flattened bottom surface 26 (see FIG. 10). Extending outwardly and downwardly from bottom surface 26 and in alignment with the outer three most fanning strip members 24 are a plurality of extension members 28 used in a known manner for wire management. Also extending from bottom surface 26 is a U-shaped bracket 30. It will be appreciated that when a cable is brought through bracket 30, the plurality of wire conductors forming said cable are then separated and selectively distributed to the fanning strip members 24 in a known manner. Extension members 28 provides support for the wire conductors which are brought out to the farthest most fanning strip members.

Extending from the oppositely opposed ends of retainer 12 are a pair of wire restraints 32. These wire restraints function in a known manner to retain and provide support for cables which are associated with the connecting block 10. Retainer 12 also includes means for detachably retaining cover 14 thereon. These attachment means include a plurality (4) of cover latches 34 which extend laterally from each sidewall 20 and 22. In addition, each opposed end of retainer 12 includes a mounting bracket latch mechanism which includes a pair of latch defeating arms 36 and associated resilient rectangular bracket latching receptacles 38. Rectangular bracket receptacles 38 have an overall box shape. Box-like support 38 comprises interior wall 150 and a facing exterior wall 152. Walls 150 and 152 are attached at the tops thereof through lateral walls 154 (see FIG. 11); and at the bottom, walls 150, 152 are attached through sidewalls 156. Support 38 is molded to retainer base 26 through a ridge 158 and sidewalls 156. Significantly, support 38 is attached to retainer 12 only at the bottom as just described. In this way, the support 38 is free to pivot inwardly as will be described below.

Figure 11:
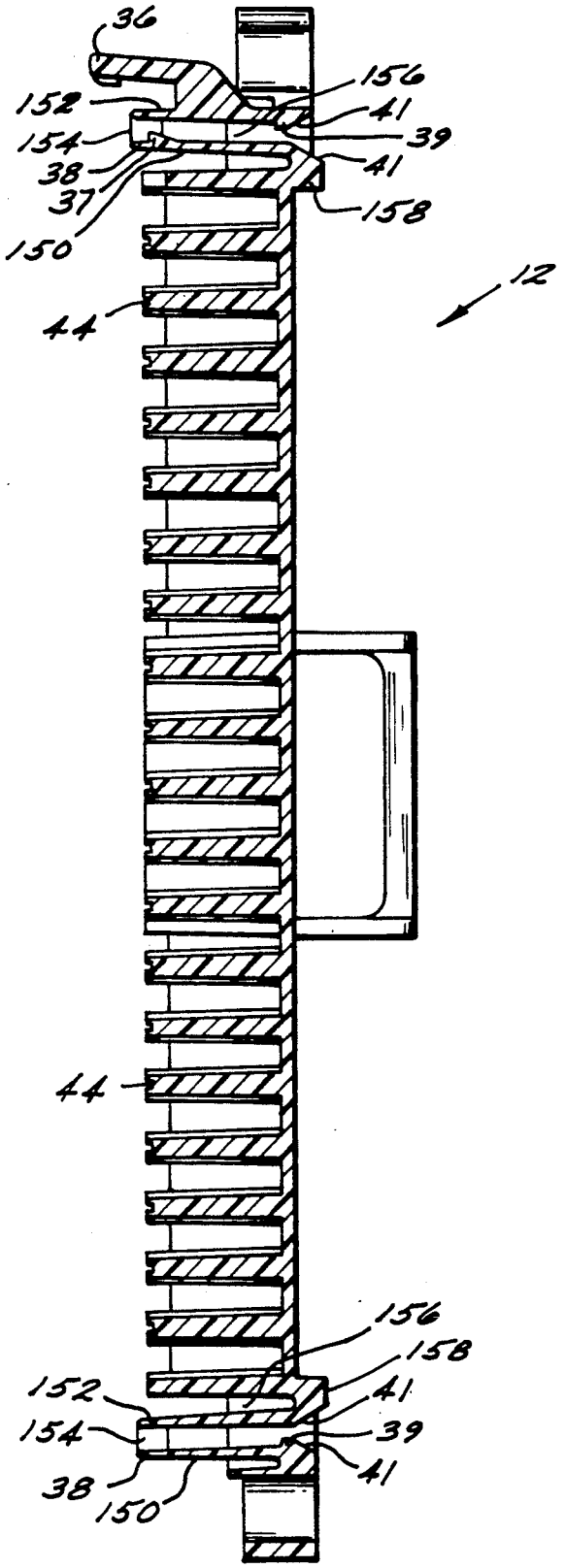
FIG. 11 is a cross-sectional elevation view along the line 11—11 of FIG. 7.
Figure 13:
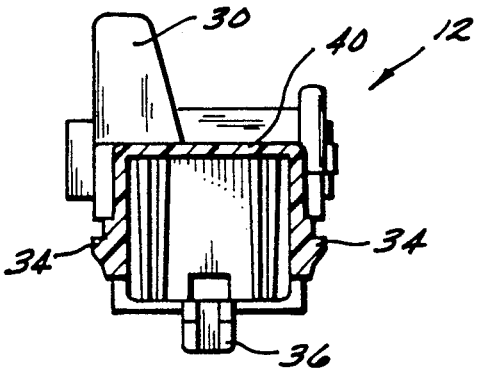
FIG. 13 is a cross-sectional elevation view along the line 13—13 of FIG. 7.
Figure 12:
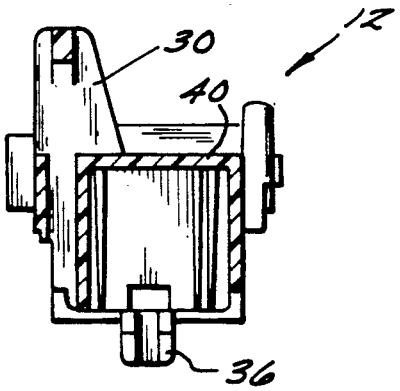
FIG. 12 is a cross-sectional elevation view along the line 12—12 of FIG. 7.
Figure 14:
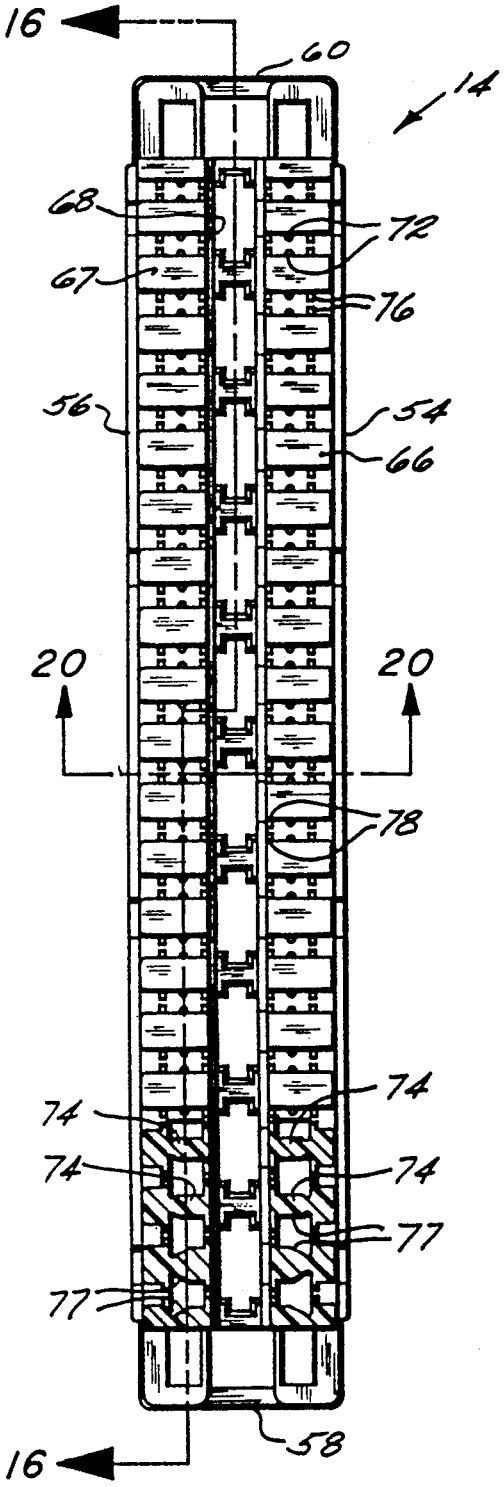
FIG. 14 is a top plan view, partly in cross-section along the line 14—14 of FIG. 15, of the cover depicted in FIG. 1.
Figure 15:
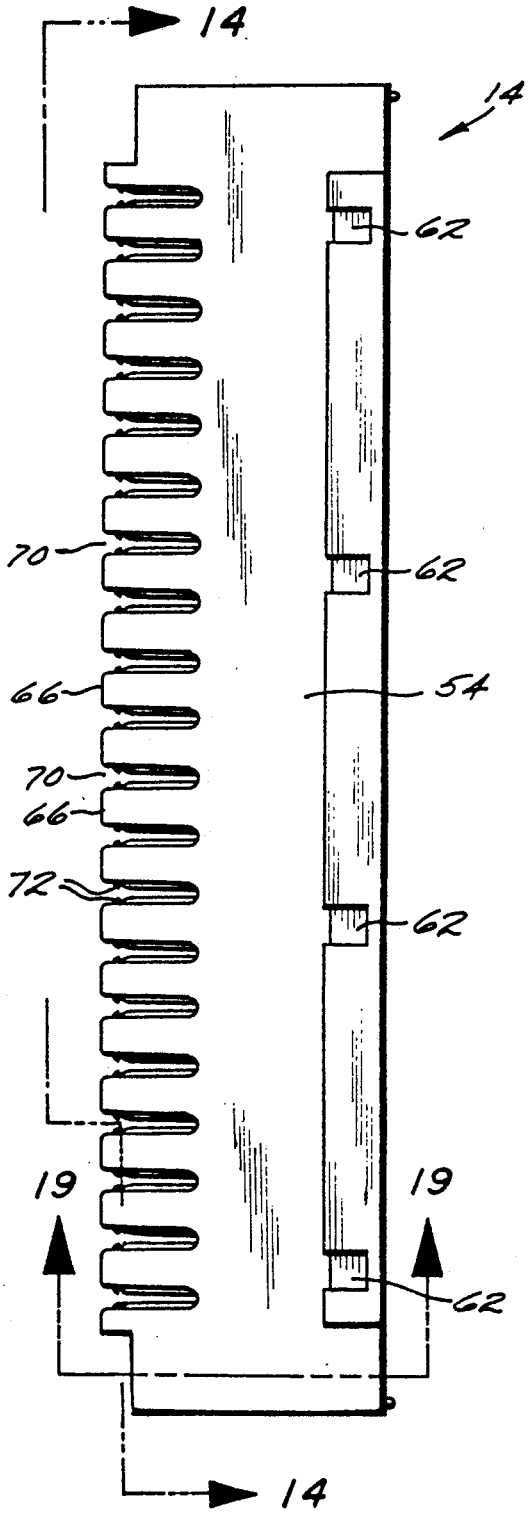
FIG. 15 is a right side elevation view of the cover of FIG. 1.

As best shown in FIG. 11, the hollow interior of each box-like support 38 includes a latch 37 and a lower stand-off feature 39. In addition, stand-off feature 39 is associated with an entry ramp 41 and is positioned such that the mounting bracket latch receptacle 210 is forced inward to engage with retainer latch 37. The relief on the inside of outer wall 150 above stand-off 39 provides a clearance space such that latch 37 and receptacle 210 may be disengaged when latch defeating arms 36 are pressed inwardly.

Figure 8:
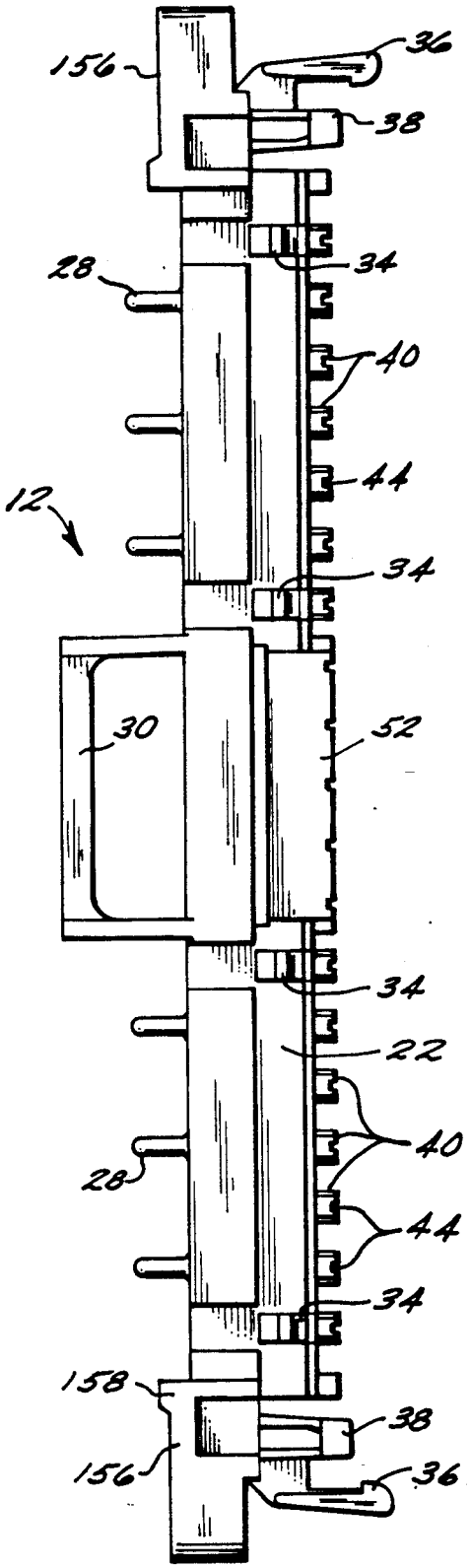
FIG. 8 is left side view of the retainer of FIG. 1.
Figure 7:
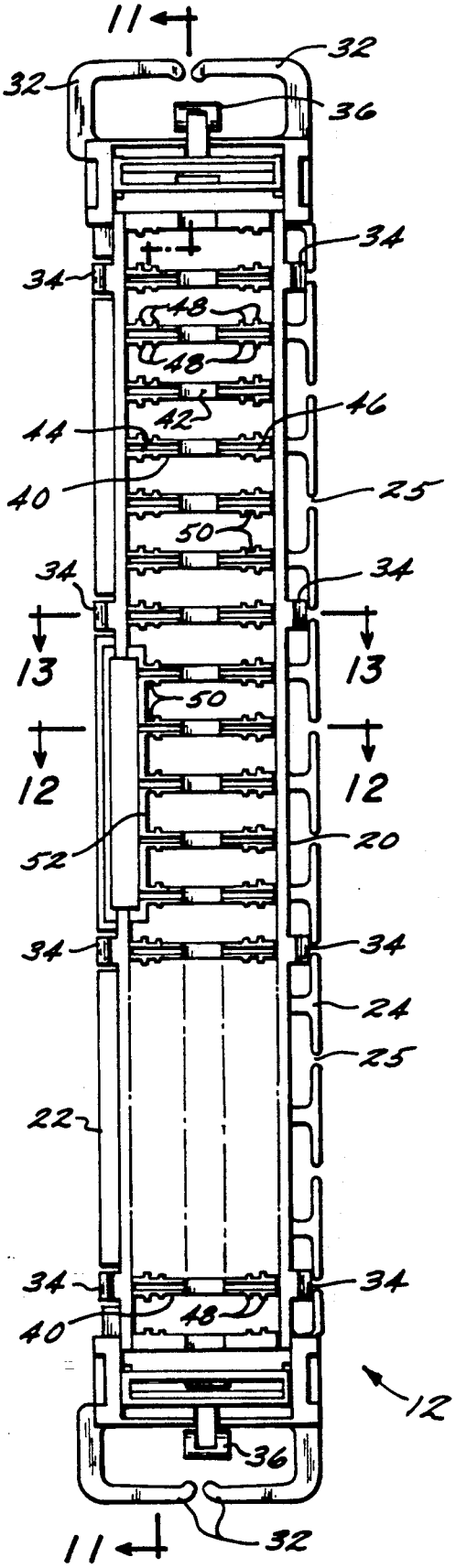
FIG. 7 is a top plan view of the retainer of FIG. 1.
Figure 9:
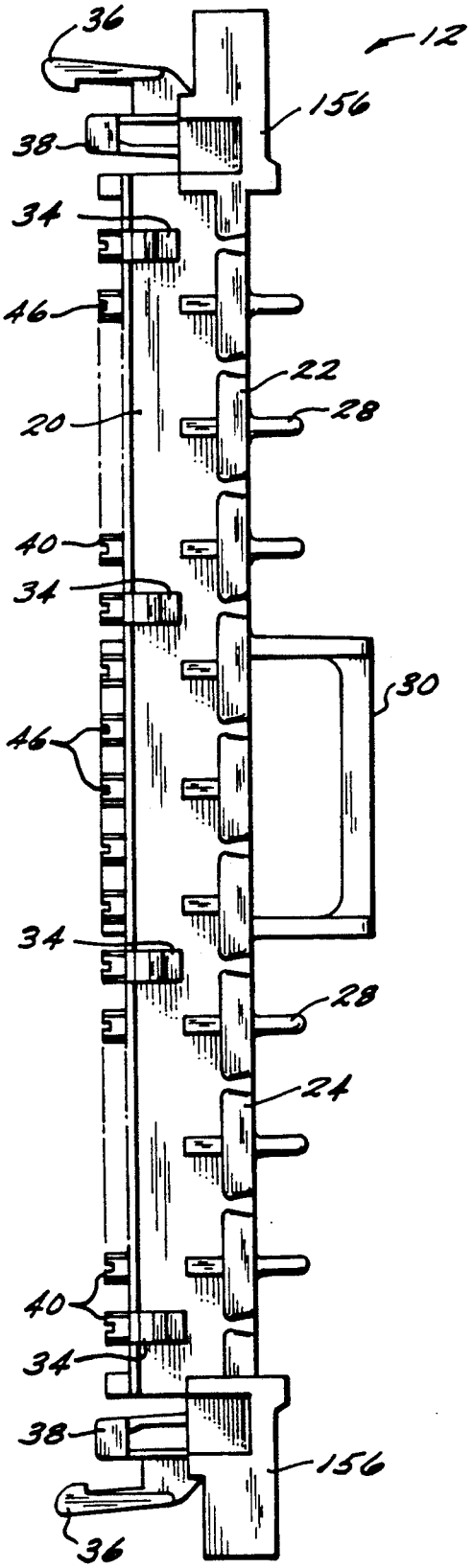
FIG. 9 is a right side view of the retainer of FIG. 1.
Figure 10:
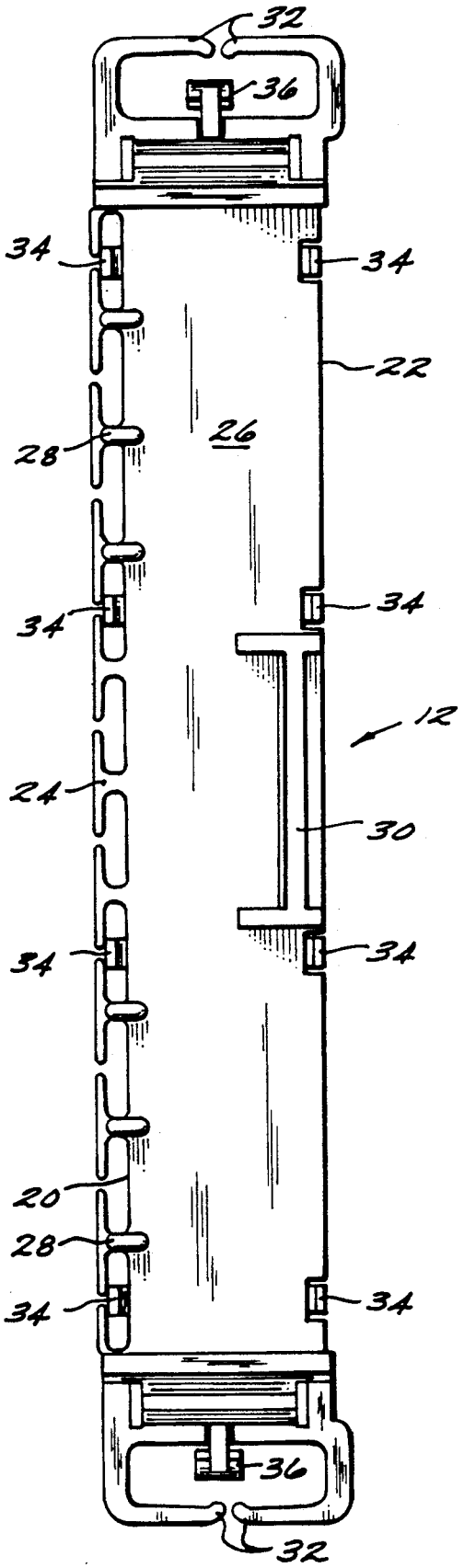
FIG. 10 is a bottom view of the retainer of FIG. 1.

The interior of retainer 14 includes a plurality of spaced cavities and other support structure for retaining and supporting terminal clips therein. This support structure includes a plurality of spaced walls 40 having a central upper notch 42 therein. On the upper edge of wall 40 on either side of notch 42 are a pair of opposed rectangular grooves 44 and 46 for the purpose of increasing electrical isolation between adjacent contact positions by placing, between them, a greater linear distance of dielectric material. Each wall 40 includes four pairs of vertical ribs 48; with each pair of ribs defining therebetween a slot 50. The slots 50 on adjacent walls 40 are aligned so as to receive terminal contacts as will be discussed hereinafter. The four pairs of ribs are distributed such that each side surface of wall 40 has two pairs of ribs with one pair of ribs being located on either side of notch 42. It will also be appreciated that the five central sidewalls 40 are joined to one another along side surface 22 by a connecting member 52 which is best shown in FIG. 8. Also, rather than a pair of ribs 48, only a single rib 48 is disposed on walls 40 adjacent to connecting member 52. Finally, it will also be appreciated that the connecting member 52 is in alignment with U-shaped bracket 30.

Referring now to FIGS. 1 and 14–20, a description now follows on cover 14. As in retainer 12, cover 14 has a substantially rectangular configuration and includes a pair of longitudinal side walls 54 and 56 and a pair of end walls 58 and 60. The lower edge of each side wall 54 and 56 includes a plurality (four) of spaced rectangular apertures 62. As shown in FIG. 2, apertures 62 are mutually spaced, aligned and sized so as to receive retainer latches 34 during assembly. Each end wall 58 and 60 of cover 14 includes a shoulder 64 and slot receptacle 65 which receives bracket latch defeating arms 36 as shown in FIG. 2. Adjacent ends 58 and 60 are rectangular openings 80 which receive bracket latching receptacles 38 from retainer 12.

Figure 17:
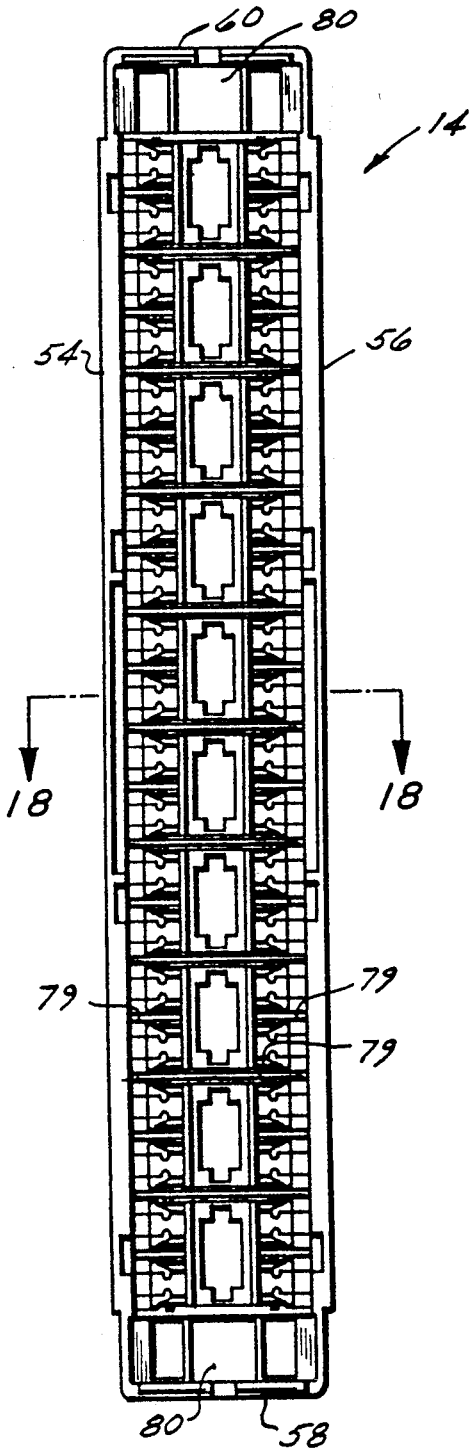
FIG. 17 is a bottom view of the cover of FIG. 1.
Figure 16:
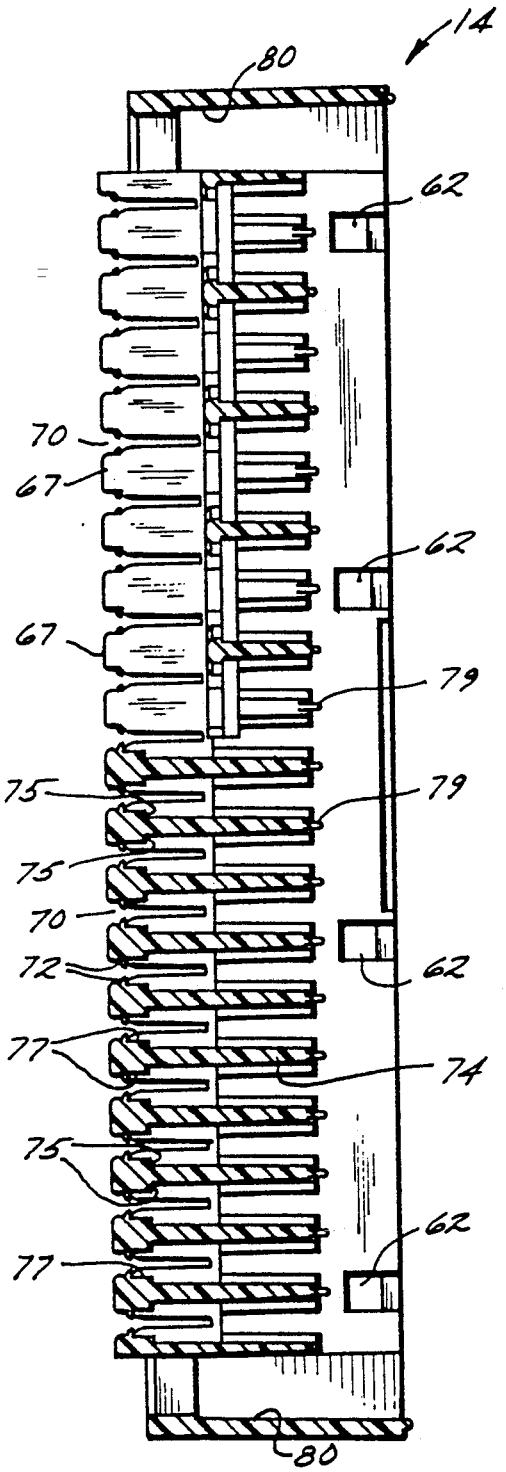
FIG. 16 is a cross-sectional elevation view along the line 16—16 of FIG. 14.
Figure 18:
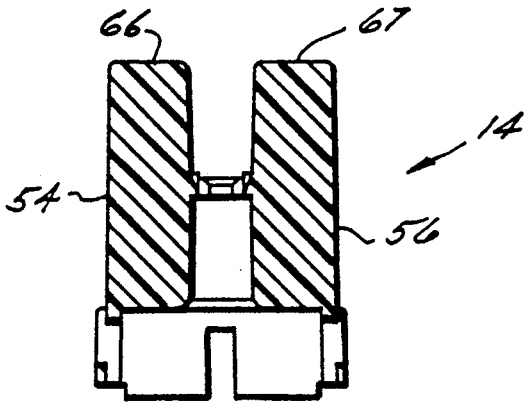
FIG. 18 is a cross-sectional elevation view along the line 18—18 of FIG. 17.
Figure 19:
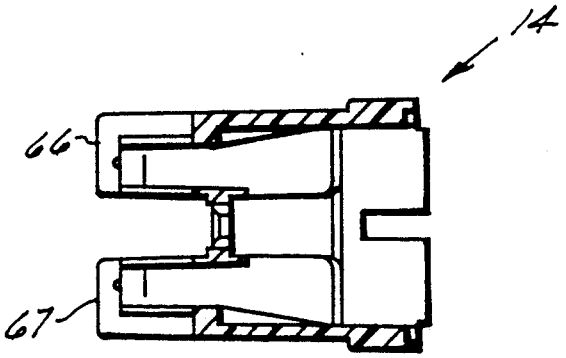
FIG. 19 is a cross-sectional elevation view along the line 19—19 of FIG. 15.
Figure 20:
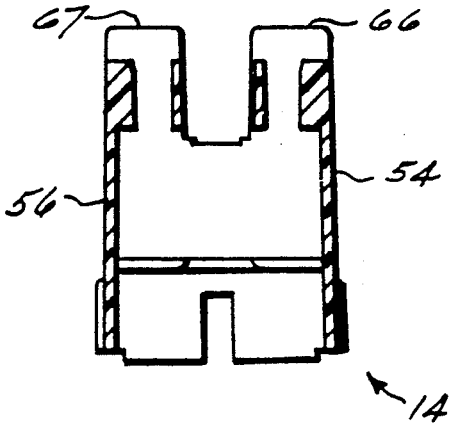
FIG. 20 is a cross-sectional elevation view along the line 20—20 of FIG. 14.

Cover 14 includes two rows of inverted U-shaped housing members 66 and 67 which extend upwardly from longitudinal sides 56 and 54, respectively. The two rows of housing members 66 and 67 are separated by an open test access area 68. As best shown in FIG. 16, each housing number 66 or 67 is spaced from adjacent housing members in a given row by an installation displacement contact slot 70. The entrance to each slot 70 includes a pair of opposed and spaced hooks 72 for retaining conductive wires prior to connection to a terminal clip. Also as shown in FIG. 16, the interior of each inverted housing member 66 or 67 includes a central support member or vertical barrier 74 between contact positions which also provide lateral contact support means. Each central support member 74 includes a pair of opposed interior shoulders 75 defining surfaces 77 which are contoured to provide both lateral and torsional support of the upper portion of the terminal clips. In addition to hook 72, stripping slot 70 includes two pairs of spaced ribs 76 and 78 (see FIG. 14) for providing strain relief of conductive wires connected to a terminal clip. As best shown in FIGS. 16 and 17, an interlocking rib 79 extends along the bottom surface of each vertical barrier 74. Ribs 79 are positioned and aligned to be received by grooves 44 in retainer 12 when cover 14 is assembled onto the retainer.

Figure 22:
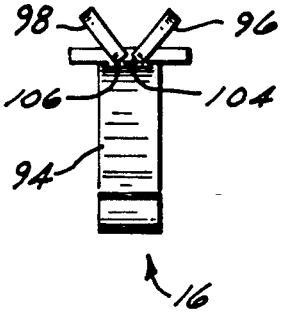
FIG. 22 is a top plan view of the terminal clip of FIG. 3.
Figure 23:
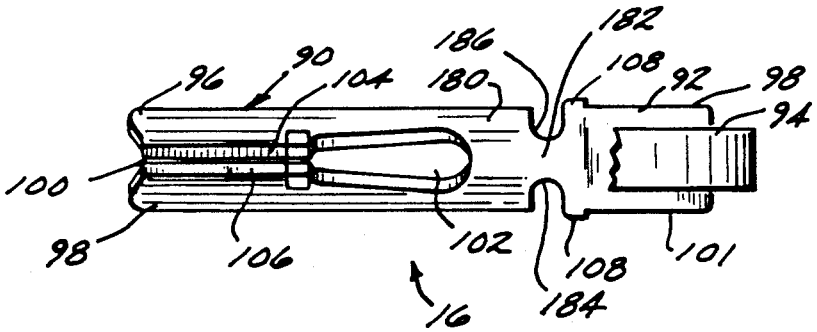
FIG. 23 is a rear view of the terminal clip of FIG. 3.
Figure 26:
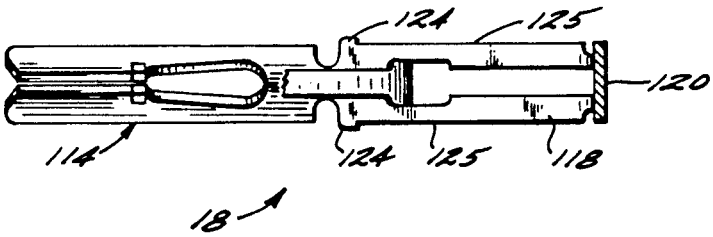
FIG. 26 is a rear elevation view of the terminal clip of FIG. 5.
Figures 24, 25, 27:
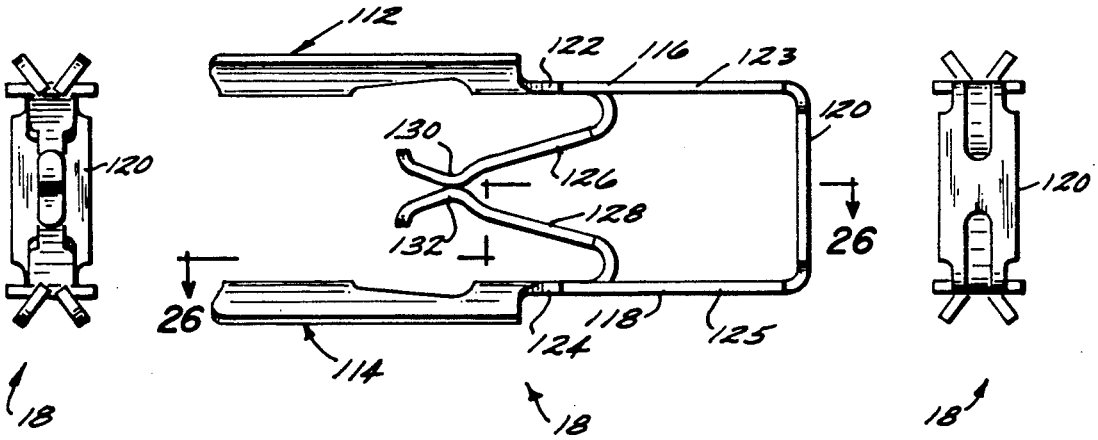
FIG. 24 is a side elevation view of the terminal clip of FIG. 5.
FIG. 25 is a top plan view of the terminal clip of FIG. 5.
FIG. 27 is a bottom view of the terminal clip of FIG. 5.

Turning to FIGS. 3 and 21–23, a first embodiment of a terminal clip 16 will now be described. Terminal clip 16 is formed from a single strip of conductive material, preferably phosphor bronze and includes an insulation displacement contact (IDC) portion 90 attached to a planar base portion 92 which terminates at an angled cantilever arm 94. IDC portion 90 is comprised of two beams 96 and 98 separated by an insulation stripping slot 100 having an open or closed (preferably closed) gap. An oblong shaped opening 102 is formed at the lower end of slot 100. As best seen in FIG. 22, beams 96 and 98 are mutually oriented so to define a V-shape from the plan view. Preferably, the included angle in the V-shape between beams 96 and 98 is between about 45° to 90° and most preferably is about 66°. Each beam 96 and 98 has an inwardly facing flattened surface 104 and 106, respectively. The corners of flattened surface 104 and 106 define edges to provide the required insulation stripping action. As is clear from a review of FIGS. 3 and 21-14 23, beams 96 and 98 terminate at a curved, generally V-shaped beam base 180. In turn, beam base 180 is connected to a narrower curved neck 182 defined by a pair of opposed, inwardly facing U-shaped notches 184, 186. Neck 182 thus defines a partially curved transition section between beam base 180 and flattened base portion 92. Base portion 92 includes a pair of opposed laterally extending stop tabs 108, and opposed stepped-in sides 99 and 101 for mating in slots 50 of retainer 12 as will be discussed in more detail below. Extending upwardly and outwardly from the bottom of base 92 at an angle of about 15° from the vertical is a cantilever arm 94. Arm 94 terminates at a rounded section 110 which has a reverse angle so as to permit access of a test probe as will be described hereinafter.

Referring to now FIGS. 5 and 24–27, the second embodiment of a terminal clip 18 will now be described. As in clip 16, clip 18 is preferably formed from a single strip of conductive material, preferably phosphor bronze. Clip 18 differs from clip 16 in that clip 18 is a dual clip while clip 16 is a single clip. Thus, clip 18 includes a pair of identical but opposite facing IDC portions 112 and 114, each of which is connected to a base 116, 118, respectively. Each base 116 and 118 is interconnected by a cross-piece 120 so that clip 18 has an overall U-shape configuration. V-shaped IDC portions 112 and 114 are substantially identical to the corresponding V-shaped IDC portion 90 in terminal clip 16. Accordingly, no further description of the details of IDC portions 112 and 114 are necessary. Similarly, each base 116 and 118 includes a pair of opposed tabs 122, 124, respectively which extend from recessed edges 123, 125, respectively. A pair of cantilever arms 126, 128, respectively are formed from base portions 116, 118 and extend upwardly at an angle in a manner similar to arm 94 in clip 16. In addition, each arm 126 and 128 includes a reversed curve section 130, 132 which forms an entry for a test probe.

Figure 4:
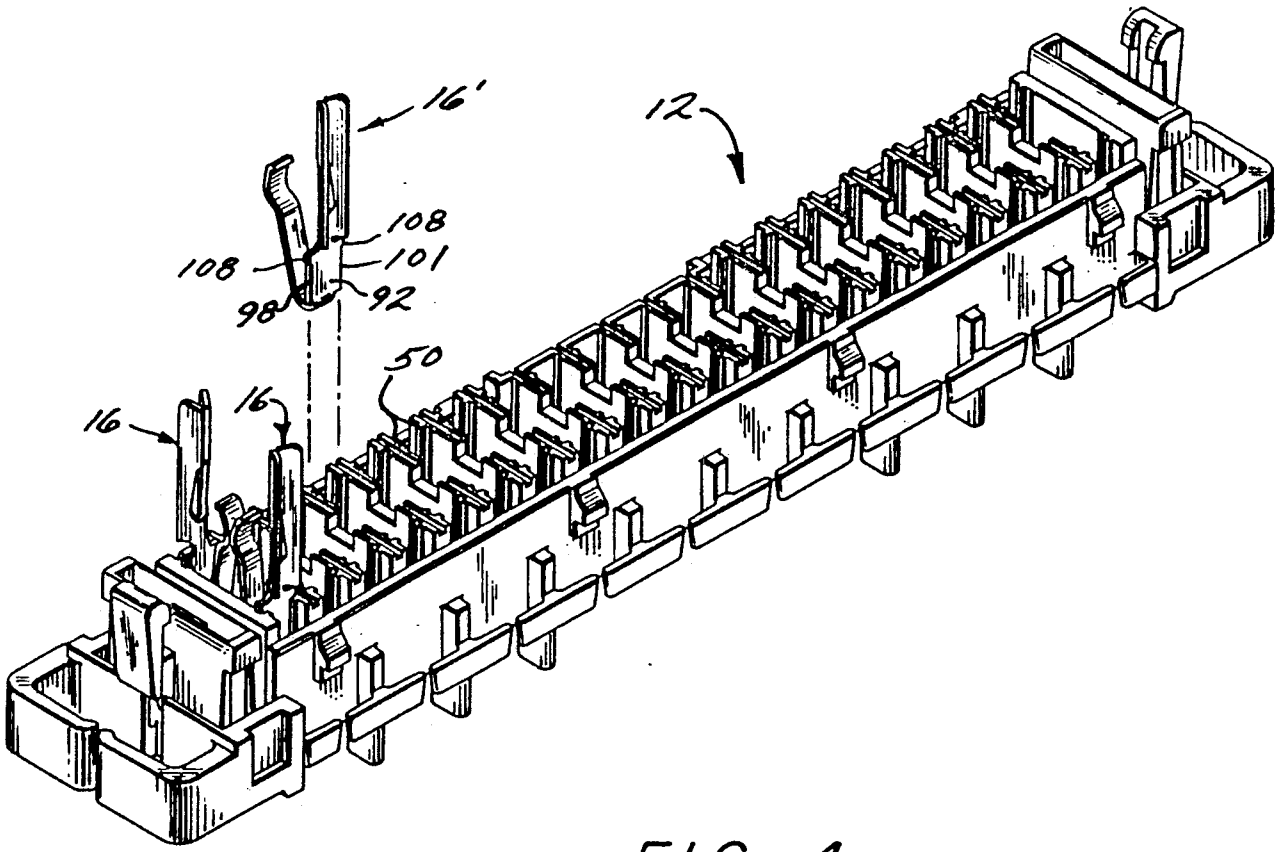
FIG. 4 is a perspective view depicting the terminal clip of FIG. 3 being loaded into the retainer base of FIG. 1.
Figure 5:
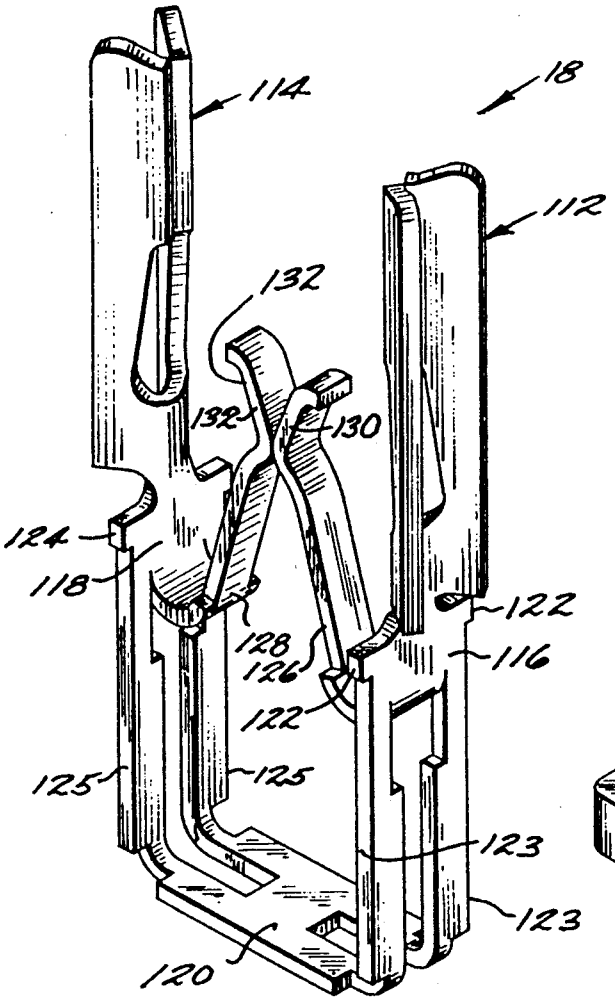
FIG. 5 is a perspective view of a second embodiment of a terminal clip in accordance with the present invention.

The connector block 10 of the present invention is assembled by initially loading retainer 12 with a plurality of contacts 16 or 18. For example, referring to FIG. 4, a retainer block 12 is depicted having a pair of contacts 16 loaded therein and having a third contact 16' in the process of being loaded. Loading of clip 16 into retainer 12 is accomplished by aligning the outer side edges 98 and 101 of base 92 of clip 16 with two mutually aligned slots 50 so that edges 98 and 101 are received in slots 50. Each clip 16 then slides downwardly within slots 50 until tabs 108 contact the upper surface of walls 40. Thus, tabs 108 act to stop clip 16 from further entry within retainer 12. It will be appreciated that slots 50 act to retain clips 16 in a vertical orientation with respect to retainer 12. Also, it will be appreciated that each recess between adjoining walls 40 will receive a pair of clips 16 and orientate said clips so that respective cantilever arms 94 will be in a facing relationship as shown in FIG. 4.

Figure 6:
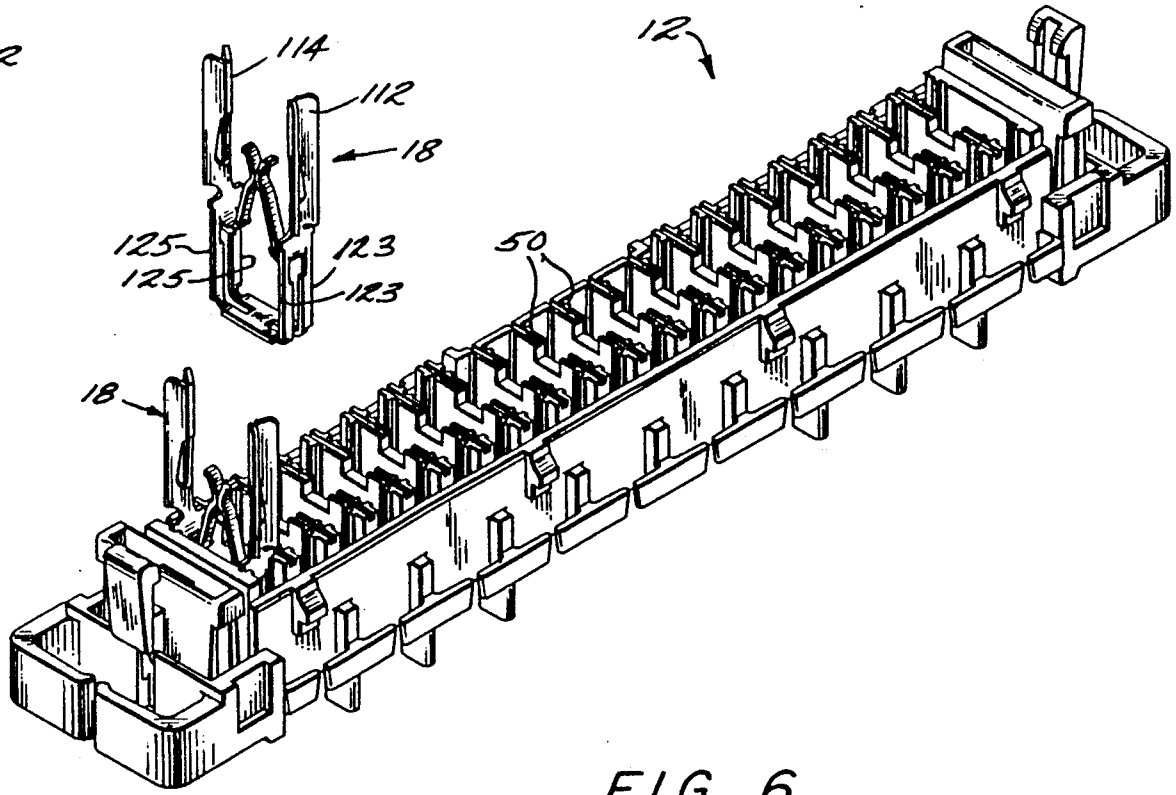
FIG. 6 is a perspective view depicting the connector clip of FIG. 5 being loaded into the retainer base of FIG. 1.

In a similar manner and with reference to FIG. 6, dual terminals clips 18 are aligned with the space between walls 40 and edges 123 and 125 are received in opposed slots 50 in a similar manner to that described above. Comparing FIGS. 4 and 6, it will be seen that the end result of loading clip 16 and 18 is the same with the important distinction that opposed pairs of clips 16 can be disconnected through an appropriate tool being urged between cantilever arms 94 providing a break test contact while opposing sides 112 and 114 of contact 18 will always remain connected, even during testing.

Referring now to FIGS. 1 and 2, in the next assembly step, cover 14 is positioned over retainer 12 and brought downwardly such that IDC portions 90 (or 112, 114), are received within housings 66 and 67. Simultaneously, stripping slots 100 will align with IDC slots 70 in cover 14. Longitudinal sidewalls 54 and 56 of cover 14 are slightly resilient so that said walls 54, 56 will flex outwardly upon contact with retainer latches 34 and then snap back to their original position when latches 34 have been received within opening 62. Simultaneously, bracket latch defeating arms 36 and rectangular bracket receptacle 38 will enter cover slots 66 and openings 80, respectively. When fully engaged, latch defeating arms 36 protrude through cover slots 65 to allow for manual deflection of the rectangular bracket receptacle 38 which are enshrouded within rectangular cover opening 80 in order to remove assembled connecting block 10 from well known mounting bracket 200.

Connector block 10 is capable of making cross-connections for ten twisted pair circuits and will terminate up to four wires in common. Of course, block 10 may be comprised in any other desired configuration other than that shown in the drawings. Connecting block 10 is also capable of terminating 20–28 AWG solid or stranded wire with a maximum of two wires per IDC slot. The connecting block of FIG. 4 which employs terminal clips 16 affords break test access which enables technicians to disconnect and reconnect circuits quickly and easily. A connecting block employing dual contact clips 18 of FIG. 6 permits parallel test access.

Connecting block 10 is configured for use with mounting hardware, installation tools and accessories that are standard in the industry for this type of connecting block.

The V-shaped IDC or "V-clip" contacts 16 and 18 are an important and novel feature of the present invention. The "V-clip" embodies a tuning fork shape similar to other prior art designs except that, rather than being coplanar, the part is formed such that the opposing beams come together to form a "V"; the base of which is the IDC slot. When placed in housing 10 which is specially contoured to support the upper surfaces and outside edges of the contact, the opposing beams are free to flex in a torsional respect. In addition, the stress relief cutout 102 at the base of the IDC slot is shaped to provide relatively even distribution of stress between the wire termination point, the slot base and housing support. This optimum stress distribution is accomplished by a combined flexure of each beam (96 and 98) surface similar to that of a flat plate supported on three sides and displaced on its fourth side by a point load. This dual action results in the preferred bowing action of the IDC slot described above with respect to prior art IDC contacts. The contact support means defined by cover surface 77 and adjoining barriers 74 constrain the contact such that it is most rigid at the wire entry point where wire insulation is displaced and most resilient at the final termination point. Unlike the inclined tuning fork terminal design which also relies on torsional flexure, in the present invention, the forces acting on the terminated wire are equal and opposite in a direction perpendicular to the wire axis. Therefore no moment is acting on the wire that would have to be counteracted by additional housing support of the wire portions entering and exiting the contact termination point. It should be noted that, while the embodiment shown does include wire strain relief, these features act independently of the means for wire termination and electrical connection under static conditions. Also, unlike prior art designs, the housing support points for the terminal clips are laterally in-line with support points on adjacent contact positions thereby placing the dielectric material in compression which is much less likely to undergo stress relaxation or viscoeleastic flow than other designs that incorporate housing support walls that are not properly balanced with those of adjacent contact positions. To further minimize the likelihood of dielectric material relaxation over long periods of time, the present invention also employs leverage and large contact support areas to resolve the high contact force necessary to maintain a dependable electrical connection.

Still another advantage offered by the V-clip is that it provides a natural locking means to prevent wire slippage or movement in the event that an individual conductor or cable bundle is pulled or disturbed while the network is electrically active. The inward orientation of the contact beam elements acts similar to a one way valve that will increase contact normal force as wire tension is increased. This one-way action is found to be sufficient because, as it is commonly known, the wire is much stronger in tension than in compression for applications that require looping in multiple contact points. Also, the wire may be oriented to enter and exit the connecting block such that the locking action of the clip is preserved.

The relatively simple contact shape which requires only a single forming operation in the IDC area lends itself to most cost effective manufacturing methods for metal stamping/forming presently available; including progressive metal stamping, multislide/vertislide and other methods for producing high volume metal stampings.

In addition, the novel V-shaped IDC contact provides connecting block 10 with excellent dependability and versatility in terms of installation life and compatible wire types using lower cost alloys and only about one half the conductive material content of standard 66-type connector clips. Other features of connecting block 10 include the latching features 36, 28 compatible with industry standard mounting bracket 200 which may be defeated without the use of tools for ease of service and maintenance.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A terminal block comprising:

a retainer, said retainer including retaining means for retaining a plurality of spaced terminal clips;

a cover removably attached to said retainer, said cover including support means for supporting a plurality of spaced terminal clips in said retainer;

at least one terminal clip in said retainer and extending into said cover, said terminal clip including an insulation displacement portion comprised of a first arm and a second arm arranged in a V shape with the base of the V defining an insulation stripping slot wherein said support means in said cover is contoured to provide lateral and torsional support to said first and second arms of said terminal clip and permit said first and second arms to flex when a wire conductor is inserted in said stripping slot, said first and second arms terminating at an arm base, said arm base being curved with the direction of the curve being commensurate with the direction of the V, said arm base being connected to a narrower neck and said neck being connected to a flattened base portion wherein said neck defines a transition between said curved arm base and said flattened base portion.

2. The block of claim 1 wherein said support means includes:

a plurality of spaced inverted U shaped housings with an insulation displacement contact slot between each U shaped housing, each of said U shaped housings including internal pairs of adjacent support members having surfaces contoured for providing said lateral and torsional support to said first and second arms of said terminal clip.

3. The block of claim 1 wherein:

said insulation stripping slot is substantially closed.

4. The block of claim 1 including:

a plurality of terminal clips in said retainer.

5. The block of claim 1 wherein:

said base portion includes a pair of opposed laterally extending stop tabs and a pair of opposed edges adjacent said stop tabs.

6. The block of claim 5 wherein said terminal clip further includes:

a cantilever arm extending outwardly from said base portion at an angle.

7. The block of claim 1 wherein said base portion includes a pair of laterally extending stop tabs and a pair of opposed edges adjacent said stop tabs and wherein said terminal clips further includes:

a pair of aligned insulation displacement portions; and a cross member interconnecting said base portions, said cross member being substantially transverse to said base portions.

8. The block of claim 7 wherein said terminal clip further includes:

a cantilever arm extending outwardly at an angle from each of said base portions, said cantilever arms being in facing relation.

9. The block of claim 1 wherein said retaining means includes:

a plurality of spaced walls, each of said walls having at least one pair of spaced ribs with a slot being defined between said pair of ribs wherein pairs of slots from adjacent walls are aligned to receive opposed edges from a terminal clip.

10. The block of claim 9 wherein:

each of said spaced walls includes a central notch.

11. The block of claim 10 wherein:

each of said walls has an upper edge and including a groove in said upper edge, on either side of said central notch.

12. The block of claim 1 wherein said retainer includes release means for releasably attaching said retainer to a mounting bracket, said release means including:

a resilient box on each opposed end of said retainer, said box having an interior and an exterior;

a latch extending outwardly within the interior of said box;

an interior stand-off element spaced downwardly from said latch; and latch defeating means extending outwardly from the exterior of said box wherein when said latch defeating means is urged inwardly, said resilient box is deflected for disengaging said latch from a mounting bracket.

13. The block of claim 12 including: entry ramp means adjacent said stand-off element.

14. A terminal block comprising:

a retainer, said retainer including retaining means for retaining a plurality of spaced terminal clips;

a cover removably attached to said retainer, said cover including support means for supporting a plurality of spaced terminal clips in said retainer;

a plurality of terminal clips in said retainer and extending into said cover; and release means for releasably attaching said retainer to a mounting bracket, aid release means including;

a resilient box on each opposed end of said retainer, said box having an interior and an exterior;

a latch extending outwardly within the interior of said box;

an interior stand-off element spaced downwardly from said latch; and latch defeating means extending outwardly from the exterior of said box wherein when said latch defeating means is urged inwardly, said resilient box is deflected for disengaging said latch from a mounting bracket.

15. The block of claim 1 wherein:

said neck is defined by a pair of opposed, inwardly facing notches.

16. The block of claim 15 wherein:

said notches are U-shaped.

17. The block of claim 1 wherein said terminal clip further includes:

a cutout through said first and second arms adjacent said stripping slot, said cutout having a shape which evenly distributes stress when a wire conductor is inserted into said stripping slot.

18. The block of claim 17 wherein:

said cutout has an elongated oblong shape.

19. A terminal block comprising:

a retainer, said retainer including retaining means for retaining a plurality of spaced terminal clips;

a cover removably attached to said retainer, said cover including support means for supporting a plurality of spaced terminal clips in said retainer;

at least one terminal clip in said retainer and extending into said cover, said terminal clip including an insulation displacement portion comprised of a first arm and a second arm arranged in a V shape with the base of the V defining an insulation stripping slot wherein said support means in said cover is contoured to provide lateral and torsional support to said first and second arms of said terminal clip and permit said first and second arms to flex when a wire conductor is inserted in said stripping slot;

and wherein said support means includes a plurality of spaced inverted U shaped housings with an insulation displacement contact slot between each U shaped housing, each of said U shaped housings including internal pairs of adjacent support members having surfaces contoured for providing said lateral and torsional support to said first and second arms of said terminal clip.

20. A terminal block comprising:

a retainer, said retainer including retaining means for retaining a plurality of spaced terminal clips;

a cover removably attached to said retainer, said cover including support means for supporting a plurality of spaced terminal clips in said retainer;

at least one terminal clip in said retainer and extending into said cover, said terminal clip including an insulation displacement portion comprised of a first arm and a second arm arranged in a V shape with the base of the V defining an insulation stripping slot, and wherein said support means in said cover is contoured to support upper surfaces and outside edges of said terminal clip so as to provide lateral and torsional support to said first and second arms of said terminal clip and permit said first and second arms to flex when a wire conductor is inserted in said stripping slot wherein said support means constrain said terminal clip so that said terminal clip is most rigid at a wire entry point where wire insulation is displaced and most resilient at a final termination point.

* * * * *

UNITED STATES PATENT AND TRADEMARK OFFICE

CERTIFICATE OF CORRECTION

PATENT NO. : 5,044,979

DATED : September 3, 1991

INVENTOR(S) : John A. Siemon, et. al.

It is certified that error appears in the above-indentified patent and that said Letters Patent is hereby corrected as shown below:

Col. 1, line 34, Begin new paragraph starting with "There is also"
Col. 5, line 11, Delete "provides" and insert therefor --provide--.
Col. 6, line 62, Delete "21-14 23" and insert therefor --21-23--.
Col. 7, line 9, Delete "to now" and insert therefor --now to--.
Col. 8, line 67, Delete "viscoeleastic" and insert therefor --viscoelastic--.
Col. 10, line 28, Delete "clips" and insert therefor --clip--.
Col. 11, line 9, Delete "aid" and insert therefor --said--.

Signed and Sealed this

Thirtieth Day of November, 1993

*Attest:*

*Attesting Officer*

BRUCE LEHMAN

*Commissioner of Patents and Trademarks*